US005836830A

United States Patent [19]

Onuki et al.

[11] Patent Number: 5,836,830

[45] Date of Patent: Nov. 17, 1998

[54] GOLF CLUB HEAD

[75] Inventors: Masahide Onuki, Miki; Masaya Tsunoda, Akashi; Kazuo Asano, Kobe, all of Japan

[73] Assignee: Sumitomo Rubber Industries, Ltd., Kobe, Japan

[21] Appl. No.: 719,965

[22] Filed: Sep. 24, 1996

[30] Foreign Application Priority Data

Sep. 25, 1995 [JP] Japan ..... 7-246302
Jun. 18, 1996 [JP] Japan ..... 8-157291

[51] Int. Cl.[6] ..... A63B 53/04

[52] U.S. Cl. ..... 473/349; 473/324

[58] Field of Search ..... 473/349, 324, 473/291

[56] References Cited

U.S. PATENT DOCUMENTS 3,995,857 12/1976 Cochran et al. ..... 473/291
3,995,858 12/1976 Cochran et al. ..... 473/291
5,224,705 7/1993 Scheie et al. .
5,366,223 11/1994 Werner et al. ..... 473/349
5,547,427 8/1996 Rigal et al. ..... 473/349 X

FOREIGN PATENT DOCUMENTS 4-56629 9/1992 Japan .
5-57034 9/1993 Japan .
7-124275 5/1995 Japan .

*Primary Examiner*—Raleigh W. Chiu
*Attorney, Agent, or Firm*—Armstrong, Westerman, Hattori, McLeland, & Naughton

[57] ABSTRACT

When a golf club head is placed on a plane with a predetermined lie angle and a predetermined loft angle, coordinate axes are arranged with a center of gravity of a golf club head as an origin, an axis perpendicular with the plane as a Z axis, an axis perpendicular with the Z axis and parallel with a tangent of a midpoint of a face of the golf club head as an X axis, and an axis intersecting the X axis and the Z axis at right angles as a Y axis. A line formed by projecting a principal axis of inertia intersecting the X axis at a most acute angle among three principal axes of inertia perpendicular with each other on an XZ plane, is arranged to intersect the X axis at an angle between 10° and 40°.

8 Claims, 17 Drawing Sheets

(CONTOUR MAP OF COEFFICIENT OF RESTITUTION OF FOURTH EXAMPLE FOR COMPARISON)

(CONTOUR MAP OF COEFFICIENT OF RESTITUTION OF TENTH EMBODIMENT)

GOLF CLUB HEAD

BACKGROUND OF THE INVENTION

1. Field of the Invention

This invention relates to a golf club head, and, more particularly, to a golf club head in which a sweet area is arranged to coincide with a distribution of impacting points on the cub head of an average golfer in order to increase a distance and directional stability of a ball.

2. Description of the Related Art

A face of a golf club head has a sweet area where coefficients of restitution at impact are high. If a golf ball is hit at the sweet area, the ball flies a long distance and the direction of the ball becomes stable. However, especially in case of a golfer with average skills (an average golfer), the points on the face, where balls to be hit are impacted, vary and a distribution of the impacting points has a relatively large area. It is therefore difficult for an average golfer to impact a golf ball accurately on the sweet area.

In order to solve the foregoing problem, attempts have been made so that balls are impacted accurately on a sweet area by enlarging the sweet area or adjusting the position of the sweet area to coincide with a distribution of impacting points.

First, as examples of attempts to enlarge a sweet area, utilizing the fact that an area of a sweet area becomes larger as the moment of inertia of a golf club head increases, the moment of inertia is increased and the sweet area is enlarged from the area indicated by 1 in FIG. 12A to the area indicated by 1' by, for example, forming a recessed portion (a cavity) on a back side of a face of an iron club head (a cavity-back configuration) and arranging weighting materials on the perimeter of the head, or enlarging the golf club head by improving the material or construction of the head.

Next, as examples of attempts to adjust a position of a sweet area to coincide with a distribution of impacting points of a golfer, utilizing the fact that the center of the sweet area substantially coincides with a point where a perpendicular from the center of gravity of the club head to the face intersects the face, the sweet area is moved from the position indicated by 1 to the position indicated by 1" by, for example, lowering the position of the center of gravity of the golf club head or arranging the center of gravity of the golf club head at the toe side as shown in FIG. 12B.

Prior art which correspond to or are concerned with the foregoing attempts are as follows.

First, Japanese Patent Provisional Publication No. 5-57034 focuses on a principal axis of inertia of a golf club head and discloses a golf club head wherein the moment of inertia is increased by increasing the weight distribution in the vicinity of the principal axis of inertia.

Japanese Patent Publication No. 4-56629 focuses on a phenomenon that when a wood club head strikes a golf ball, the club head rotates and a spin is produced on the ball if the impacting point is off the center of gravity of the golf club head, a hook spin is given to the golf ball if the impacting point is toward the toe from the center of gravity, and a slice spin is given to the ball if the impacting point is toward the heel (gear effect). The Japanese Patent Publication No. 4-56629 also makes investigation into the gear effect concerning various impacting points, and discloses improving a golf club head by finding an axis that forms the boundary between the hook spin and the slice spin (a true axis of rotation). In other words, in Japanese Patent Publication No. 4-56629, a bulge of a wood club head is arranged with the true axis of rotation as its axis, and the moment of inertia is increased by increasing the weight distribution in a direction vertical with the true axis of rotation.

U.S. Pat. No. 5,224,705 describes an iron of said cavity-back configuration wherein the configuration of the cavity is arranged to increase the weight distribution in the upper portion of the toe and the lower portion of the heel of the golf club head in order to increase the moment of inertia on the true axis of rotation.

On the other hand, the present inventors actually conducted an experiment on a golf club head impacting a ball and made investigation into a distribution of impacting points on a club head where balls are impacted when average golfers hit golf balls.

In this investigation, three kinds of golf club heads, i.e., a No. 5 iron, a No. 1 wood, and a No. 9 iron were used and fifteen average golfers actually shot a predetermined number of golf balls, and distributions of impacting points were examined.

FIG. 13 shows an example of a distribution of impacting points of a No. 5 iron (a distribution of impacting points concerning one of the fifteen golfers).

In FIG. 13, an axis of abscissa x is, as shown in FIG. 14A and FIG. 14B, an axis parallel with a plane 7 where a golf club head 5 is arranged so that the golf club head 5 has a predetermined lie angle $\alpha$ and a predetermined loft angle $\beta$, and is a straight line passing a midpoint R of a face 5*a* in a heel-toe direction. The heel-toe direction is a direction parallel with the plane 7 and is in a direction joining a heel 5*c* (an end portion at a neck portion 5*b* side) and a toe 5*d* (an end portion at the opposite side of the neck portion 5*b*). On the other hand, an axis of ordinate z indicates a space from the midpoint R of the face 5*a* in a vertical direction (up-down direction) against the axis of abscissa x.

As shown in FIG. 13, a distribution of impacting points of an average golfer is in a elliptical configuration as indicated by 2 which is long in the direction of the axis of abscissa x, and when a golf club head 5 is arranged to have the predetermined lie angle $\alpha$ and the predetermined loft angle $\beta$, the elliptical configuration inclines toward a bottom portion 5*e* of the golf club head 5 and the plane 7.

Coordinates of the axis of abscissa x and the axis of ordinate z of each impacting point 11 shown in FIG. 13 are measured, a major axis 1 of the ellipse 2 composed of the distribution of impacting points is obtained through the method of least squares, and an inclination of the ellipse 2 composed of the distribution of impacting points is obtained.

In order to obtain an inclination of the distribution of impacting points, as shown in FIG. 14A and FIG. 14B, with the golf club head 5 arranged on the plane 7 so that the golf club head 5 forms the predetermined lie angle $\alpha$ and the predetermined loft angle $\beta$, orthogonal coordinate axes are arranged with the center of gravity G of the golf club head 5 as an origin, an axis in a direction perpendicular with the plane 7 as a Z axis, an axis parallel with the straight line passing the midpoint of the face 5*a* in the heel-toe direction and perpendicular with the Z axis as an X axis (in case of an iron head, the face 5*a* is a plane, therefore an axis parallel with the face 5*a* and perpendicular with the Z axis becomes this X axis), and an axis perpendicular with the X axis and the Z axis as a Y axis, and an angle between the X axis and a line of projection 1' which is formed by projecting the major axis 1 of the distribution of impacting points on a XZ plane is obtained.

Inclinations of distributions of impacting points when fifteen golfers hit balls with the No. 5 iron were examined, and distribution of numbers of person concerning the inclinations of the distributions of impacting points is shown in FIG. 15B. In a similar manner, concerning the No. 1 wood and the No. 9 iron, a distribution of impacting points and an inclination of the distinctions of impacting point of each golfer were examined, and distribution of numbers of persons is shown in FIG. 15A and FIG. 15C. The FIGS. 15A, 15B and 15C show that inclinations of the distributions of impacting points when average golfers shoot balls centers on a range from 10° to 40° substantially regardless of the kind of the golf club head.

However, comparing the distribution of impacting points of an average golfer obtained from the foregoing experiment with the conventional attempts wherein the area of the sweet area is enlarged or the position of the sweet area is changed, as shown in FIG. 12A and FIG. 12B, the major axis 1 of the distribution of impacting points 11 of an average golfer do not coincide with the sweet area 1' and 1", and the distribution of impacting points of an average golfer and the sweet area are not identical. As for the attempt to enlarge the sweet area by increasing the moment of inertia, the weight of the club head should not be heavier than a certain weight in view of function as a club head, therefore there is a limit in increasing the moment of inertia.

On the other hand, Japanese Patent Provisional Publication No. 5-57034 only increases the moment of inertia by increasing weighting materials in the vicinity of the principal axis of inertia, and the position and the inclination of the sweet area on the face are not changed, therefore it is not possible to arrange the sweet area to coincide with the distribution, of impacting points of an average golfer which the present inventors have found.

Japanese Patent Publication NO. 4-56629 and U.S. Pat. No. 5,224,705 focus on the true axis of rotation concerning gear effect for improving a golf club head, but do not directly regard relation between the distribution of impacting points of a golfer and the sweet area. It is therefore impossible to arrange the sweet area to coincide with the distribution of impacting points of an average golfer on the basis of these prior art.

On the other hand, Japanese Patent Provisional Publication No. 7-124275 describes an improvement in a golf club head focusing on the distribution of impacting points.

Japanese Patent Provisional Publication No. 7-124275 teaches that the distribution of impacting points of golf balls on the face is elliptical and inclines against the bottom portion of the club head, and describes arranging a direction of a principal axis which indicates the smallest moment of inertia of a face configuration projected on a plane to coincide with the major axis of the ellipse of the distribution of impacting points, aiming for lowering the frequency in impacting a ball absolutely, or partly, off the boundary of the face of the driver.

However, also in the case of Japanese Patent Provisional Publication No. 7-124275, the sweet area can not be easily arranged to coincide with the actual distribution of impacting points. This is because an actual golf club head has a three-dimensional configuration and the distribution of the weight is also three-dimensional, and it is necessary to arrange the moment of inertia taking consideration into the three-dimensional configuration and the weight distribution. However, in Japanese Patent Provisional Publication No. 7-124275, the direction indicating the smallest moment of inertia of a configuration of the face projected on a plane is adjusted to coincide with the distribution of impacting points. And, regarding the face as a plane, only the moment of inertia of the plane is taken into consideration. Therefore it is difficult to arrange the sweet area of an actual club head having the three-dimensional configuration and weight distribution to coincide with the distribution of impacting points of an average golfer.

With the construction disclosed by Japanese Patent Provisional Publication No. 7-124275, even if it is possible to arrange the configuration of the sweet area to incline and coincide with the distribution of impacting points on an average golfer, the golf club head is taught to have a configuration considerably different from a conventional configuration. In this case, in golf which is regard as an extremely mental sport, it is difficult for a golfer to accept the club head having an appearance different from a conventional configuration.

SUMMARY OF THE INVENTION

It is therefore an object of the present invention to solve the foregoing problems in conventional golf club heads and improve a distance and directional stability of a golf ball hit by an average golfer.

It is a second object of the present invention to provide a golf club head wherein the configuration of the sweet area is inclined to coincide with the distribution of impacting points of an average golfer, while keeping a configuration of a conventional golf club head.

It is a third object of the present invention to provide an iron-type or wood-type golf club head having a suitable construction in which the configuration of the sweet area is inclined to coincide with the distribution of impacting points of an average golfer.

In order to solve the first problem, the present inventors conducted various kinds of simulations and experiments under the influence of mechanical properties such as the weight of the golf club head and the moment of inertia on the sweet area of the golf club head, and clarified that the configuration of the sweet area depends on the principal axis of inertia and principal moments of inertia of the club head. Explanation of how the sweet area relates to the principal axes of inertia and principal moments of inertia is going to be described below.

First, a sweet area generally indicates, as described in the foregoing, an area having higher coefficients of restitution among the face, but it is not defined formally. In the present invention, a sweet area is defined as an area formed by joining points on the face where the coefficient of restitution is lower for a definite value than the maximum coefficient of restitution on the face. A coefficient of restitution is a value obtained by dividing a speed of a golf club head immediately before the club head impacts against a golf ball into an initial velocity of the golf ball immediately after being hit by the golf club head. In the following explanation, the definite value of decrease in coefficient of restitution is 0.02. Decrease of 0.02 in coefficient of restitution is equivalent to decrease of approximately 5 yards, which value changes due to the kind of the golf club head and the golf ball to be hit, in distance of flight.

In case three-dimensional orthogonal coordinates axes (an X-Y-Z coordinate system) are arranged, moments of inertia 1xx, 1yy, 1zz on X axis, Y axis, and Z axis are defined by the following equations, $$1_{XX} = \int\rho(r)(Y^2+Z^2)dV \qquad \text{Equations 1}$$
$$1_{YY} = \int\rho(r)(Z^2+X^2)dV$$
$$1_{ZZ} = \int\rho(r)(X^2+Y^2)dV$$

Products of inertia are defined by the following equations.

$$1_{XY} = 1_{YX} = \int\rho(r)XYdV \qquad \text{Equations 2}$$
$$1_{ZX} = 1_{XZ} = \int\rho(r)ZXdV$$
$$1_{YZ} = 1_{ZY} = \int\rho(r)YZdV$$

In the foregoing Equations 1 and Equations 2, ρ is density and is a function of a position vector r. When an origin of the orthogonal coordinate axes is arranged at a center of gravity of a rigid body, a relation between an angular momentum L and an angular velocity ω is expressed as follows, utilizing the moments of inertia and the products of inertia.

$$L = 1\omega \begin{pmatrix} L_X \\ L_Y \\ L_Z \end{pmatrix} = \begin{pmatrix} 1_{XX} & -1_{XY} & -1_{XZ} \\ -1_{YX} & 1_{YY} & -1_{YZ} \\ -1_{ZX} & -1_{ZY} & 1_{ZZ} \end{pmatrix} \begin{pmatrix} \omega_X \\ \omega_Y \\ \omega_Z \end{pmatrix} \qquad \text{Equations 3}$$

In Equations 3, Lx, Ly, $L_z$ are X, Y, Z components of the angular momentum, and ωx, ωy, ωz are X, Y, Z components of the angular velocity.

A principal axis of inertia is an axis for reference when arranging coordinates axes for examination of movement of a rigid body, and when this principal axis of inertia is expressed in orthogonal coordinate axes, in Equations 3 which express the relation between the angular momentum L and the angular velocity ω, a non-diagonal term of the following symmetric matrix of three rows and three columns, (−1xy, −1xz, −1yx−1yz−1zx, −1zy) becomes 0, and the relational equation becomes independent. Therefore, an eigenvector of this symmetric matrix of three rows and three columns indicates the direction of the principal axis of inertia.

$$\begin{pmatrix} 1_{XX} & -1_{XY} & -1_{XZ} \\ -1_{YZ} & 1_{YY} & -1_{YZ} \\ -1_{ZX} & -1_{ZY} & 1_{ZZ} \end{pmatrix} \qquad \text{Equation 4}$$

A principal moment of inertial is a moment of inertia on a principal axis of inertia.

First, how the sweet area relates to the principal axes of inertia and the principal moments of inertial when a ball is impacted vertically on a rectangle board which is homogeneous with the length in the direction of the X' axis (the horizontal direction) sufficiently larger than the length in the direction of the Z' axis (the vertical direction) as shown in FIG. 16A is going to be examined below.

In this case, the major axis direction of the sweet area 16 coincides with the X' axis direction, and becomes a substantial ellipse which is long in the X' axis direction in which the minor axis coincides with the Z' axis. The major axis and the minor axis of the sweet area 16 coincide with the X' axis and the Z' axis respectively because the rectangle board 17 is symmetrical against the X' axis and the Z' axis and the principal axes of inertial ξ, ζ coincide with the X' axis and Z' axis. The sweet area 16 becomes long in the X' axis direction because a principal moment of inertia on a principal axis of inertia ζ which coincides with the Z' axis is bigger than a principal moment of inertia on a principal axis of inertia ζ which coincides with the X' axis.

Next, as shown in FIG. 16B, among four vertexes 17*a,* 17*b,* 17*c,* 17*d* of the rectangle board 17, weight of portions in the vicinity of the vertexes 17*b,* 17*d* on a diagonal $a_1$ is moved to the vertexes 17*a,* 17*c* on the other diagonal $a_2$. In this case, the overall weight of the board 17' is identical with that of the rectangle board 17 in FIG. 16A, but the sweet area 16 rotates toward the diagonal $a_2$ where the weight was moved. The principal axes of inertia ξ, ζ in this case also rotate toward the diagonal $a_2$ where the weight was moved, and are positioned similarly with the axes of the sweet area 16. However, the principal axes of inertia vary due to the overall weight distribution, therefore even when a part of the weight is moved as in the foregoing case, they do not always rotate for the moved amount toward the moved direction.

As described in the foregoing, when a golf ball is perpendicularly impacted on the rectangle board 17, the configuration of the sweet area 16 depends on the principal axes of inertia ξ, ζ and the principal moments of inertia on the principal axes of inertia ξ, ζ. The present inventors conducted simulations in impacting a ball on the rectangle board 17 with an angle equivalent to a loft angle β (see FIG. 14B) and also in impacting a ball on a rectangular parallelepiped having a sufficient thickness instead of a board, and confirmed that the configuration of the sweet area on the face 5*a* depends on the principal axes of inertia and the principal moments of inertia.

In this invention, utilizing the fact that the sweet area can be arranged to have a desired configuration by arranging the principal axes of inertia and the principal moments of inertia, the sweet area is arranged so that the configuration of the sweet area coincides with the distribution of impacting points obtained experimentally.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 14A:
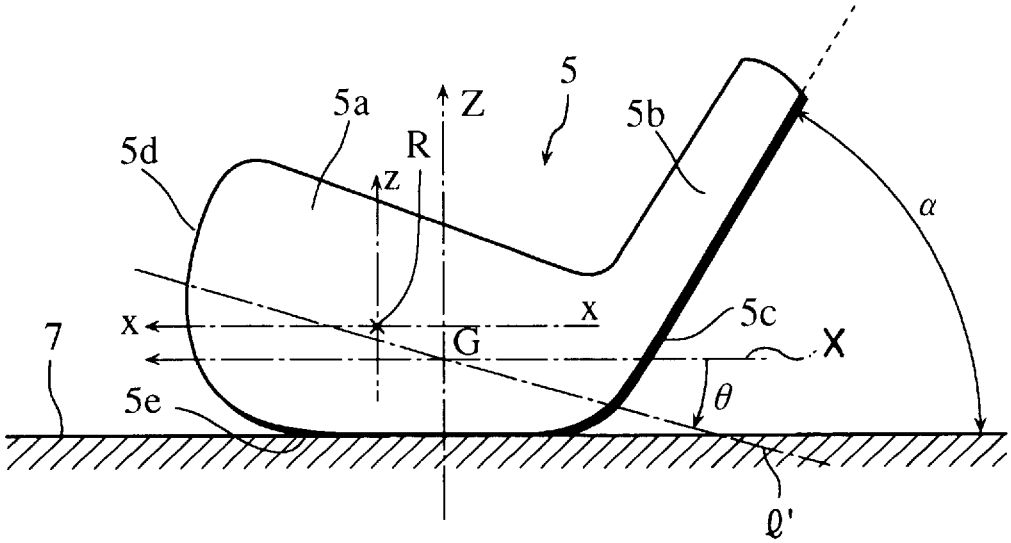
FIG. 14A is a front view of a golf club head for explaining a lie angle.
Figure 14B:
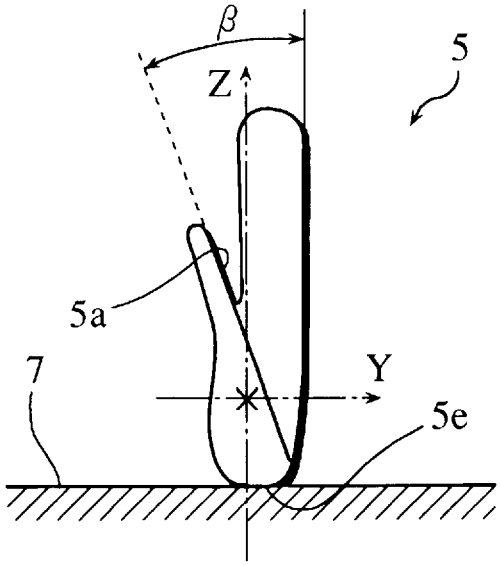
FIG. 14B is a side view of a golf club head for explaining a loft angle.

In the following explanation, as shown in FIG. 14A and 14B, under a situation wherein a golf club head 5 is arranged on a plane 7 and form a predetermined lie angle $\alpha$ and a predetermined loft angle $\beta$, as shown in FIG. 14A, FIG. 14B, FIG. 1A and FIG. 1B, orthogonal coordinate axes are formed with a center of gravity G of the golf club head 5 as, an origin, an axis in a direction perpendicular with the plane 7 where the golf club head 5 is arranged as a Z axis, an axis parallel with a tangent of the midpoint R of the face 5*a* and perpendicular with the Z axis as an X axis (in case of an iron head, the face 5*a* is a plane, therefore an axis parallel with the face 5*a* and perpendicular with the Z axis becomes this X axis), and an axis perpendicular with the X axis and the Z axis as a Y axis.

As described in the foregoing, the distribution of impacting points of an average golfer is elliptical, and an angle between the X axis and a line of projection 1' which is formed by projecting a major axis 1 of the ellipse on the XZ plane is 10° to 40° in most cases, therefore, in order to adjust the sweet area to the distribution of impacting points, it is necessary to arrange the sweet area so that aline formed by projecting a principal axis of inertia which intersects the X axis at a most acute angle on the XZ plane inclines within a range of 10° to 40°.

Figure 2A:
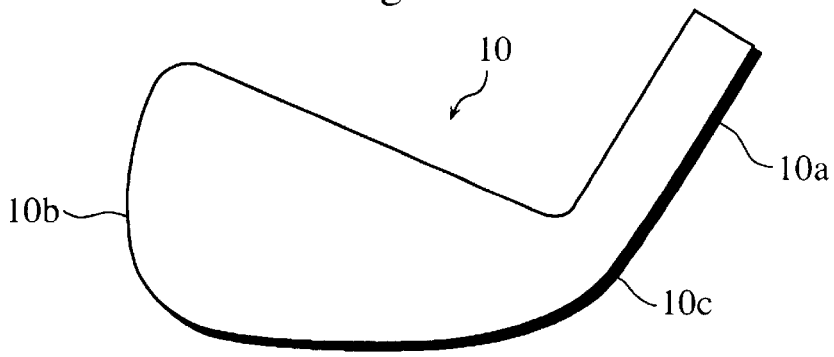
FIG. 2A is a front view showing a golf club head on the market.

The present inventors deformed a golf club head 10 on the market shown in FIG. 2A (a No. 5 iron of FX-31 produced by Sumitomo Rubber Industries, Ltd. Japan) and examined the inclinations of principal axes of inertia. The FX-31 is a golf club head which is arranged to have a cavity back configuration in order to enlarge the area of the sweet area.

Figure 16A:
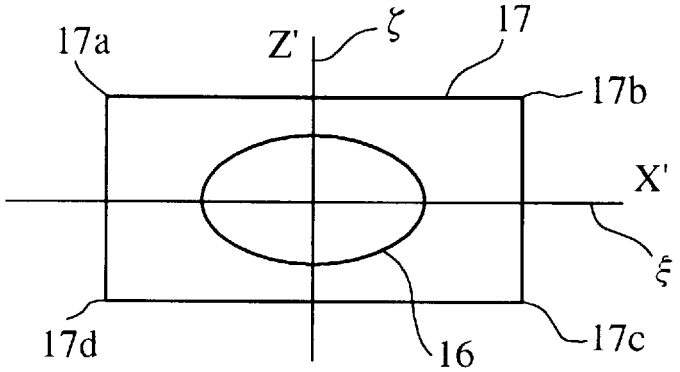
FIG. 16A is a front view showing how a sweet area relates to principal axes of inertia and principal moments of inertia in case of a rectangle board.
Figure 16B:
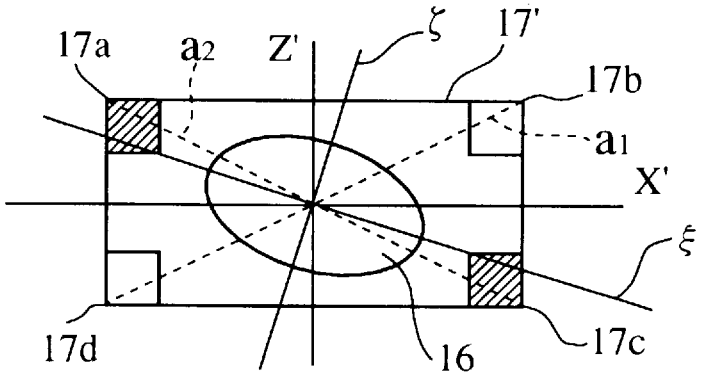
FIG. 16B is a front view showing how a sweet area relates to principal axes of inertia and principal moments of inertia in case of a rectangle board when a part of the vicinity of a vertex of the rectangle board is moved to another vertex.

From the relation between the weight distribution and the principal axes of inertia and principal moments of inertia of the rectangle board 17 in FIG. 16A and FIG. 16B, it, is possible to arrange an angle between the X axis and a line formed by projecting a principal axis of inertia intersecting the X axis at a most acute angle among three principal axes of inertia of a golf club head on the XZ plane to be between 10° and 40° by distributing more weight in the lower portion of the heel side and the upper portion of the toe side. In this case, a principal moment of inertia on a principal axis of inertia intersecting the X axis at the most acute angle among the three principal axes of inertia becomes smaller than a principal moment of inertia on a principal axis of inertia intersecting the Z axis at a most acute angle among the three principal axes of inertia which are perpendicular with each other, and a sweet area becomes long in a direction from the lower portion of the heel side of the face to the upper portion of the toe side.

On the other hand, it is also possible to arrange an angle between the X axis and a line of a principal axis of inertia intersecting the X axis at a most acute angle among three principal axes of inertia projected on the XZ plane to be between 10° and 40° by distributing more weight in the upper portion of the heel side and the lower portion of the toe side. However, in this case, the principal moment of inertia on the principal axis of inertia intersecting the X axis at the most acute angle among the three principal axes of inertia becomes larger than a principal moment of inertia on a principal axis of inertia intersecting the Z axis at a most acute angle among the three principal axes of inertia which are perpendicular with each other, and the sweet area does not become long in a direction from the lower portion of the heel side of the face to the upper portion of the toe side.

Figure 2B:
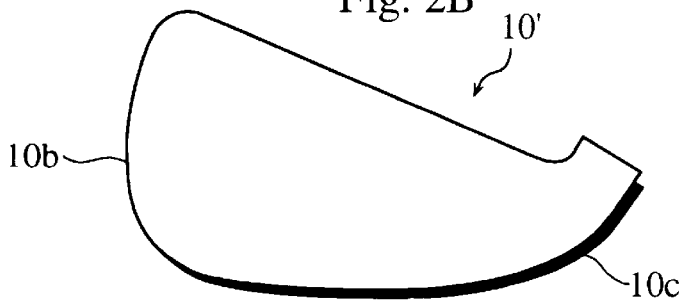
FIG. 2B is a front view showing a golf club head of a trial manufacture 1.
Figure 2C:
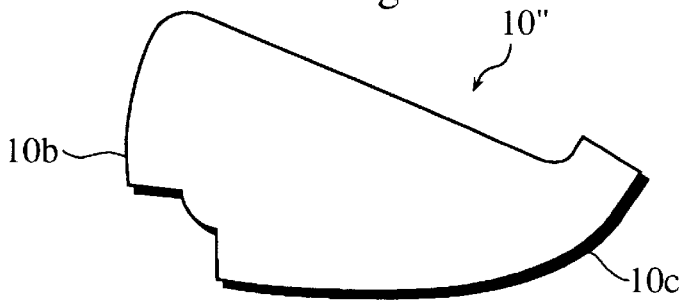
FIG. 2C is a front view showing a golf club head of a trial manufacture 2.
Figure 2D:
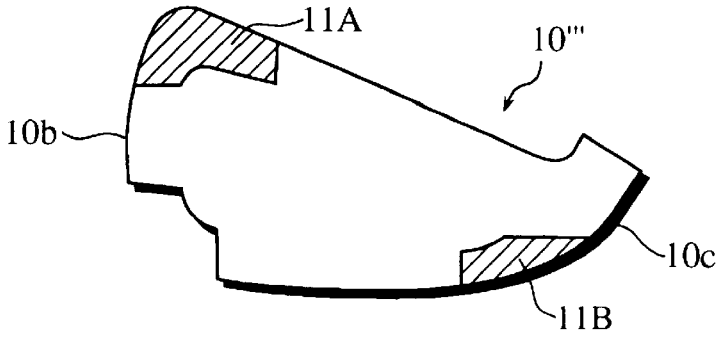
FIG. 2D is a front view showing a golf club head of a trial manufacture 3.

Concerning four kinds of golf clubs, i.e., the golf club head on the market 10, a golf club head 10' which is produced by removing the neck portion 10*a* from a golf club head on the market 10 as shown in FIG. 2B (a trial manufacture 1), a golf club head 10" which is produced by removing 20 grams of the lower portion of the toe 10*b* side of a golf club head 10' as shown in FIG. 2C (a trial manufacture 2), and a golf club head 10"' which is produced by replacing portions 11A, 11B with oblique lines in the upper portion of the toe 10*b* side and the lower portion of the heel 10*c* side of a golf club head 10" by metal of higher specific gravity (tungsten) as shown in FIG. 2D (a trial manufacture 3), investigation was made into inclinations of principal axes of inertia.

The principal axes of inertia and principal moments of inertia were measured as follows.

First, a three-dimensional configuration of a golf club head was measured using a three-dimensional configuration measuring machine, and a finite element method (FEM)

model was formed through a preprogram for structural analysis on the basis of the measurement data of the three-dimensional configuration. Next, using the FEM model, the principal axes of inertia and the principal moments of inertia were calculated through an analysis software on the market. (An example of this kind of software is a general purpose impact analysis software LS-DYNA sold by The Japan Research Institute, Limited (Japan). This software is an analysis software for calculating stress on impact, and it is also possible to use the software for calculating principal axes of inertia and principal moments of inertia under the initial shaping of an object.)

Directional cosines of the three principal axes of inertia of the golf club head on the market as shown in the following Equation 5.

$$\xi = \begin{pmatrix} 0.9883 \\ -0.1326 \\ -0.0752 \end{pmatrix} \eta = \begin{pmatrix} 0.1467 \\ 0.9618 \\ 0.2313 \end{pmatrix} \zeta = \begin{pmatrix} 0.0416 \\ -0.2396 \\ 0.9700 \end{pmatrix} \quad \text{Equations 5}$$

One the principal axes of inertia $\xi$, $\eta$, $\zeta$, wherein an inner product of these directional cosines and a unit vector e (1, 0, 0) in the direction of the X axis is the smallest, is the principal axis of inertia which intersects the X axis at a most acute angle. For example, the inner product of the directional cosine of the principal axis of inertia $\xi$ and the unit vector e in the direction of the X axis is expressed by the following Equation 6

$$\xi \cdot e = |\xi||e|\cos\phi \quad \text{Equation 6}$$

($\phi$ is an angle between the vectors.)

Figure 1A:
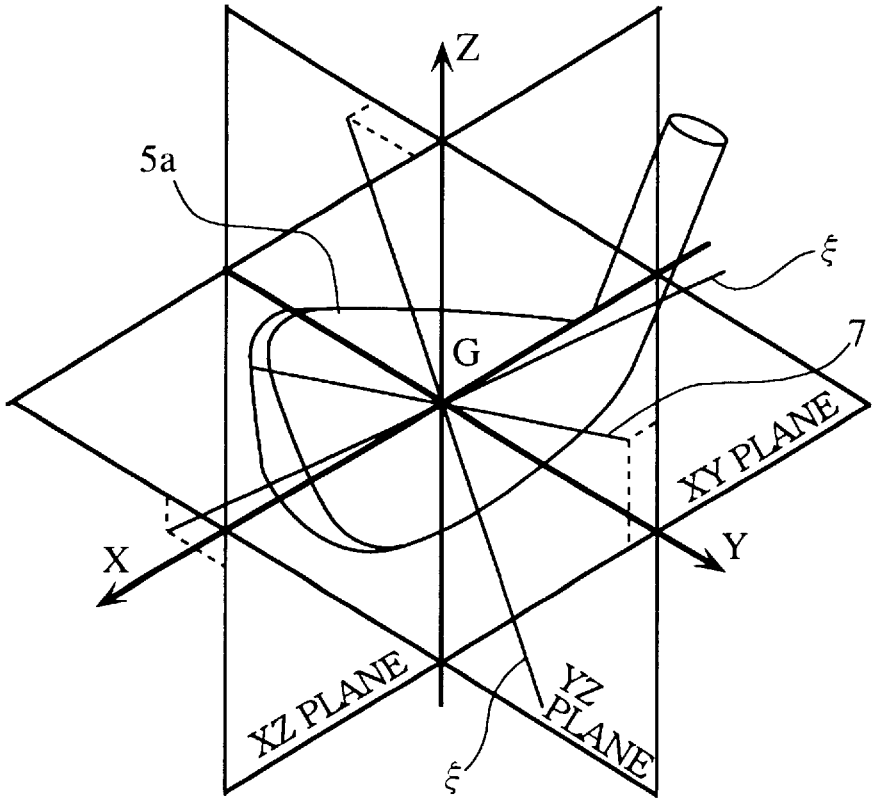
FIG. 1A is a schematic perspective view for explaining an arrangement of coordinates in the present invention.
Figure 1B:
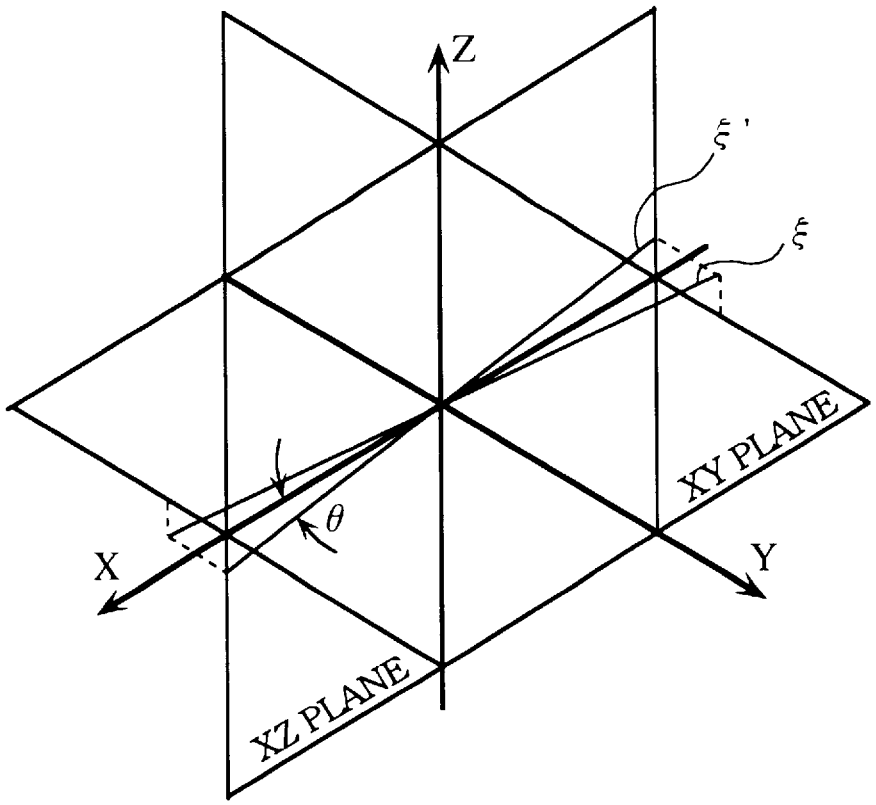
FIG. 1B is a schematic perspective view for arranging a principal axis of inertia of a golf club head according to the present invention.

Inner products of directional cosines of three principal axes of inertia $\xi$, $\eta$, $\zeta$ and a unit vector in the direction of the X axis concerning each of the golf club head on the market and the trial manufactures 1, 2, 3 were calculated, and in each case, the principal axis of inertia $\xi$ intersected the X axis at a most acute angle. An angle $\theta$ between the X axis and a line of projection $\xi'$ which is formed by projecting the principal axis of inertia $\xi$ on the XZ plane is obtained from the X component and Z component of the directional cosine through the following Equation 7. As for the plus and minus of an angle $\theta$ with the X axis, in FIG. 1B, the clockwise direction when the head is viewed from the plus direction of the Y axis is a plus. The angle $\theta$ illustrated in FIG. 1B is minus accordingly.

Equation 7

$$\theta = \tan^{-1} (\text{Z component/X component})$$

As described above, concerning each of the golf club head on the market, the trial manufacture 1, the trial manufacture 2, and the trial manufacture 3, an angle between the X axis and a straight line which is formed by projecting a principal axis of inertia $\xi$ which intersects the X axis at a most acute angle on the XZ plane was measured, and the results are shown in Table 1.

TABLE 1

| | Weight (g) | Inclination of Principal Axis of Inertia θ (degree) |
|---|---|---|
| Article on the Market | 250 | −4.3 |
| Trial Manufacture 1 | 233 | 5.6 |
| Trial Manufacture 2 | 213 | 9.8 |
| Trial Manufacture 3 | 246 | 21.2 |

Figure 3A:
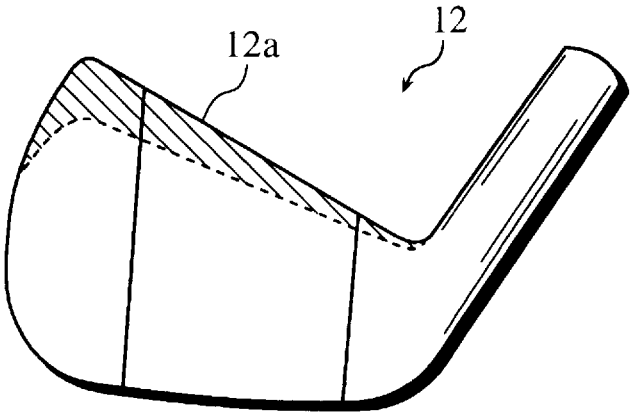
FIG. 3A is a front view of a golf club head in which a weight distribution has been changed.
Figure 3B:
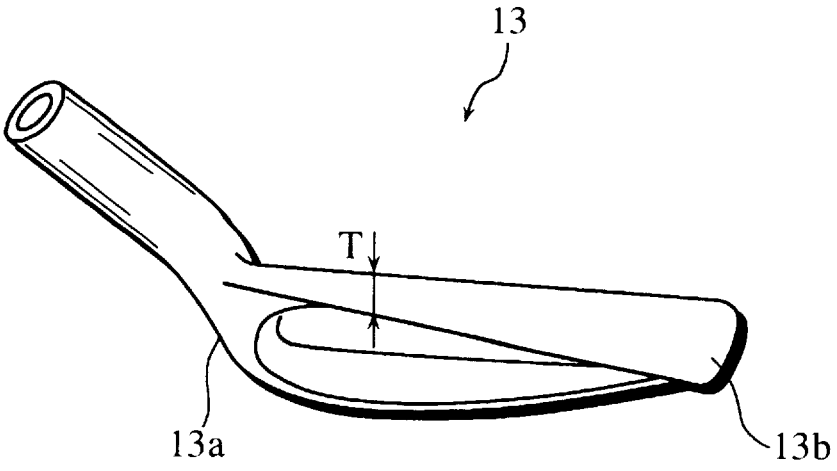
FIG. 3B is a top view of a golf club head in which a weight distribution has been changed.

As shown in Table 1, it is confirmed while an inclination of the principal axis of inertia of the article on the market 10 is −4.3°, an inclination $\theta$ of a principal axis of inertia can be arranged to have various values by changing the weight distribution as the trial manufacture 1, trial manufacture 2, and trial manufacture 3. The method to change inclination $\theta$ of a principal axis of inertia is not limited to the method described above. For example, as a golf club head 12 shown in FIG. 3A, it is possible to enlarge an inclination angle of the upper end portion (the top blade) of the club head by enlarging the upper end portion of the face 12*a,* which portion is shown with oblique lines, of the golf club head on the market 10. As a golf club head 13 shown in FIG. 3B, it is also possible to arrange the configuration of the sole so that the sole becomes thin gradually from the heel 13*a* to the toe 13*b* and the top blade becomes thick gradually from the heel 13*a* to the toe 13*b*. It is not always necessary to omit the neck portion and use alloy of higher specific gravity as the trial manufactures 1, 2, 3.

It is possible to calculate the principal axes of inertia and principal moments of inertia using a surface model produced with CAD software from the three-dimensional configuration measurement data. In this case, according the foregoing equations of definition, the center of gravity of the volume surrounded by the surface of the surface model, the moments of inertia passing the center of gravity and on each of the X axis, Y axis, and Z axis, and the products of inertia are obtained from calculation. In this method, in general, the CAD model is divided into minute volume elements, the moments of inertia and products of inertia concerning each of the volume elements are calculated from the position and mass of each volume element, and all the volume elements are added. In this case, the principal axes of inertia and principal moments of inertia are obtained by calculating the eigenvalues and eigenvectors of the symmetric matrix of the three rows and the three columns shown in Equation 4. In this calculation, it is possible to obtain the proper equation of Equation 4 or using a numerical calculation such as the Jacobi method.

Next, as described in the foregoing, on the basis that the configuration of the sweet area depends on the principal axes of inertia and the principal moments of inertia and inclinations of the principal axes of inertia can be changed by changing the weight distribution of the golf club head, five kinds of golf club heads of first to fifth embodiments, each having a sweet area in which a configuration is adapted to the distribution of impacting points of an average golfer with the major axis intercepting the X axis at an angle between 10° and 40°, were manufactured.

Figure 4A:
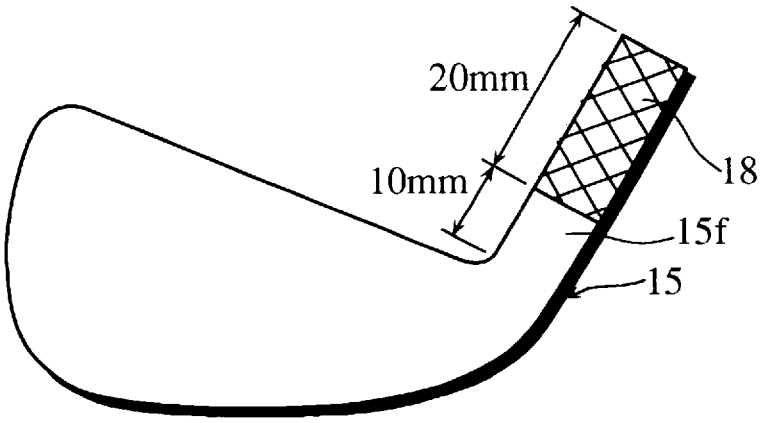
FIG. 4A is a schematic front view of a golf club head according to the present invention.
Figure 4B:
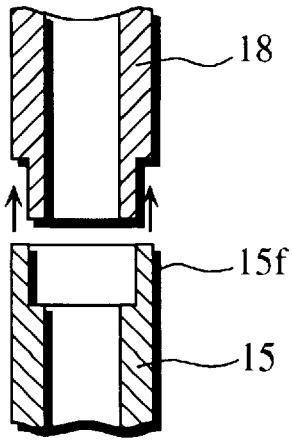
FIG. 4B is a partially sectional view showing how a neck portion is formed.

With the golf club head on the market, a No. 5 iron of FX-31 produced by Sumitomo Rubber Industries, Ltd. (Japan), as a standard configuration, each golf club head is manufactured by deforming a golf club head 15 shown in FIG. 4 so that the length of the neck portion 15*f* is 10 mm, each portion is arranged to have dimensions shown in Table 2, and the principal axis of inertia which intersects the X axis at a most acute angle intersects the X axis at an angle between 10° and 40°.

A sixth embodiment has a glued joint construction with the neck portion 15*f* of 10 mm connected with a titanium cylindrical material 18 of 20 mm using epoxy adhesive, and the whole length of the neck portion is 30 mm.

Figure 5A:
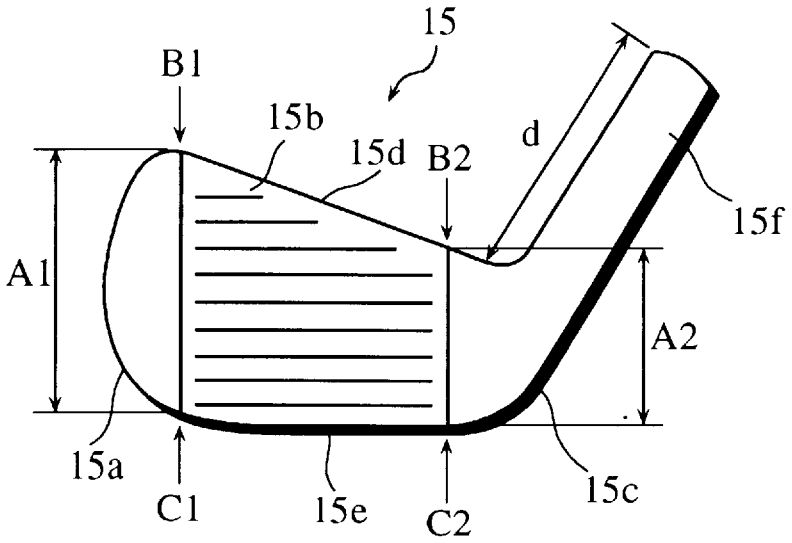
FIG. 5A is a front view of a golf club head for explaining dimensions.
Figure 5B:
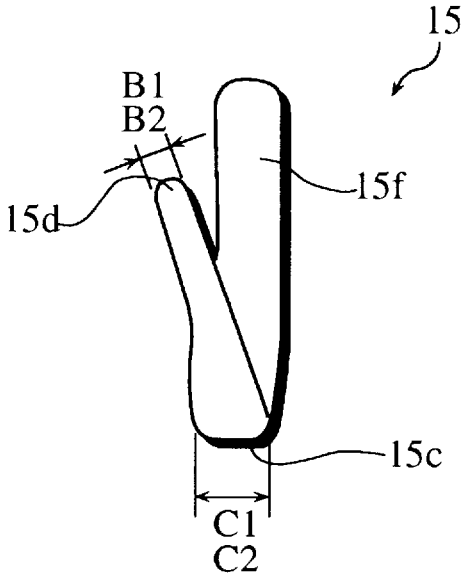
FIG. 5B is a side view of a golf club head for explaining dimensions.

In FIG. 5, d indicates the length of the neck portion 15*f,* A1 indicates the width of the face 15*b* at the toe 15*a* side, A2 indicates the width of the face 15*b* at the heel 15*c* side. B1 indicates the width of the blade 15*d* at the toe 15*a* side, B2 indicates the width of the blade 15*d* at the heel 15*c* side, C1 indicates the width of the sole 15*e* of the toe 15*a* side, and C2 indicates the width of the sole 15*e* at the heel 15*c* side.

The dimensions of the golf club heads 15 of the first to sixth embodiments are as shown in Table 2.

TABLE 2

| | Weight (g) | Neck Length d (mm) | Face Width A1 (mm) | Face Width A2 (mm) | Blade Width B1 (mm) | Blade Width B2 (mm) | Sole Width C1 (mm) | Sole Width C2 (mm) | Inclination of Principal Axis of Inertia (deg.) | Coefficient of Restitution Impacting Point A | Impacting Point B | Lowering Rate (%) |
|---|---|---|---|---|---|---|---|---|---|---|---|---|
| First Example for Comparison (DP-201) | 262 | 50 | 51.5 | 32.5 | 4.0 | 4.0 | 17.5 | 12.0 | −12 | 1.480 | 1.421 | 96.0 |
| Second Example for Comparison (FX-31) | 250 | 50 | 53.5 | 31.0 | 7.5 | 7.5 | 21.5 | 15.0 | −4 | 1.446 | 1.396 | 96.5 |
| Third Example for Comparison | 248 | 10 | 53.5 | 31.0 | 7.5 | 7.5 | 21.5 | 15.0 | 0 | 1.450 | 1.404 | 96.8 |
| First Embodiment | 250 | 10 | 53.5 | 31.0 | 7.5 | 7.5 | 18.0 | 18.0 | 10 | 1.449 | 1.418 | 97.9 |
| Second Embodiment | 249 | 10 | 53.5 | 31.0 | 10.0 | 5.0 | 14.0 | 22.0 | 21 | 1.453 | 1.432 | 98.6 |
| Third Embodiment | 250 | 10 | 60.0 | 31.0 | 12.0 | 4.0 | 10.0 | 25.0 | 31 | 1.441 | 1.420 | 98.5 |
| Fourth Embodiment | 250 | 10 | 65.0 | 31.0 | 15.0 | 4.0 | 6.0 | 27.0 | 35 | 1.444 | 1.419 | 98.3 |
| Fifth Embodiment | 250 | 10 | 13.0 | 31.0 | 20.0 | 3.0 | 3.0 | 30.0 | 39 | 1.438 | 1.395 | 97.0 |
| Sixth Embodiment | 250 | 30 | 60.0 | 31.0 | 11.0 | 4.0 | 10.0 | 24.0 | 22 | 1.445 | 1.445 | 98.4 |

Each of the golf club heads 15 of the first to sixth embodiments was manufactured by forming a configuration having the dimensions shown in Table 2 through CAD software and shaving a stainless steel material using a numerically controlled machine tool. The weight of each golf club head is adjusted to be 250 g by adjusting the configuration of the recessed portion of the cavity-back, and the weight was minutely adjusted through polishing.

In Table 2, a FEM model was produced on the basis of CAD data as described above in order to obtain an inclination θ of a principal axis of inertia. Each of the first to sixth embodiments was arranged so that a principal axis of inertia which intersects the X axis at a most acute angle inclines with an angle between 10° to 40°, which coincides with the inclination of the distribution of impacting points of an average golfer.

As described in the foregoing, a configuration of a sweet area of an golf club head depends on an inclination of a principal axis of inertia, therefore, when the principal axis of inertia which intersects the X axis at the most acute angle is arranged to incline with an angle within the foregoing range, the sweet area is also limited within a range of 10° to 40° which in the inclination of the distribution of impacting points of an average golfer.

Figure 13:
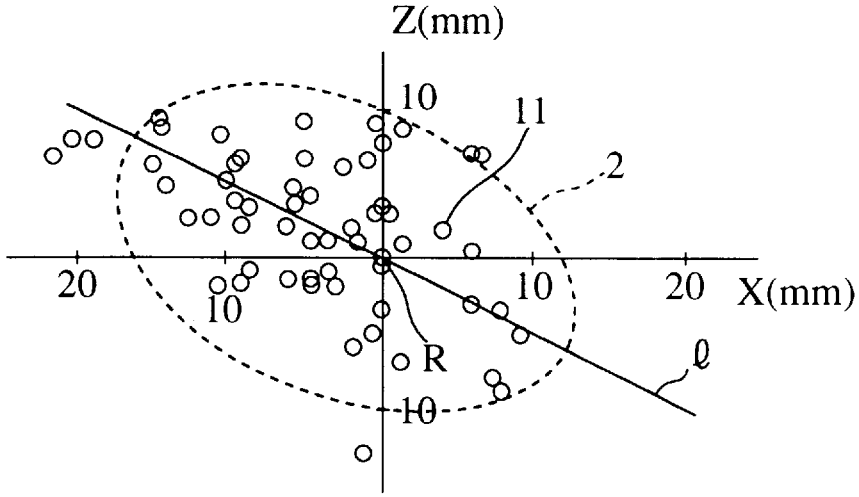
FIG. 13 is a diagram showing an example of a distribution of impacting points of an average golfer obtained from an experiment.

The first to sixth embodiments were respectively arranged so that an inclination of a principal axis of inertia which intersects the X axis at a most acute angle is within the range of the distribution of impacting points of an average golfer, and the configuration of the sweet area also depends on the principal moments of inertia as described above. It is desirable to arrange the principal moment of inertia on the principal axis of inertia which intersects the X axis at the most acute angle among the three principal axes of inertia to be smaller than a principal moment of inertia on a principal axis of inertia which intersects the Z axis at a most acute angle. When the principal moments of inertia are thus arranged, the sweet area becomes long in a direction from the lower portion of the heel side to the upper portion of the toe side of the face of the golf club head and better fits the configuration of the distribution of impacting points of an average golfer shown in FIG. 13.

An experiment was made in order to confirm effect of the golf club heads of the first to sixth embodiments. In this experiment, coefficients of restitution were measured by actually hitting a golf ball using a golf club head 15 of each of the first to sixth embodiments. Golf club heads of first to third examples for comparison were manufactured and compared with the golf club heads of the first to sixth embodiments. Dimensions of the golf club heads of the first to third examples for comparison area as shown in Table 2. The first example for comparison has a configuration corresponding to a No. 5 iron of DP-201 produced by Sumitomo Rubber Industries, Ltd. (Japan), and the second example for comparison has a configuration corresponding to a No.5 iron of FX-31 produced by Sumitomo Rubber Industries, ltd. (Japan), The first example for comparison has a flat-back configuration wherein the rear face is not provided with a cavity, the second and the third examples for comparison have cavity-back configurations similar to the first to sixth embodiments, and stainless steel is used as the material.

Figure 6:
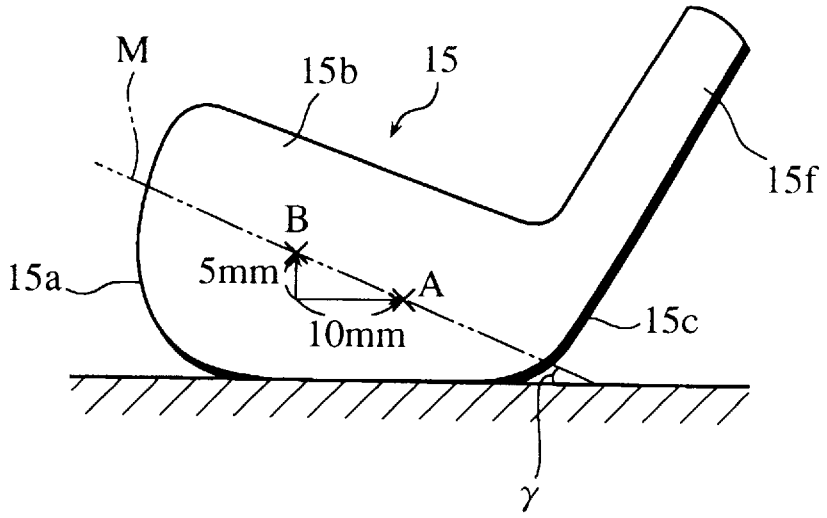
FIG. 6 is a front view of a golf club head for explaining impacting points in an experiment.

In this experiment, a golf ball was hit by a machine for hitting balls using each of the golf club heads of the first to sixth embodiments and the first to third examples for comparison, and a coefficient of restitution at a point A and a coefficient of restitution at a point B on the face 15*b* of the golf club head 15 shown in FIG. 6 were measured and compared. A head speed at impact was arranged to be approximately 38 m/s, a ball was hit five times for each of the point A and the point B.

The point A is a point where the face intersects a perpendicular from the center of gravity of the golf club head toward the face, and a coefficient of restitution at this point A is maximum among coefficients of restitution on the face as described in the foregoing. On the other hand, the point B is spaced from the point A for 10 mm toward the toe 15*a* side and 5 mm toward the upper side on the face 15.

Figure 15A:
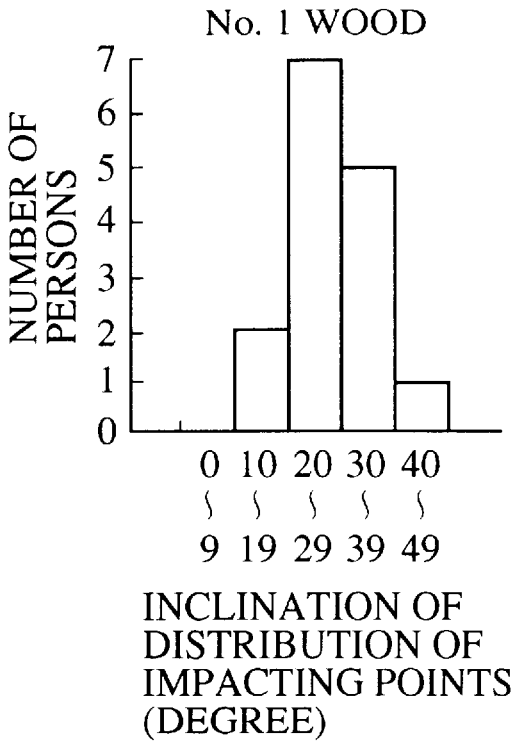
FIG. 15A is a graphical representation showing a distribution of numbers of persons concerning an inclination of a distribution of impacting points of an average golfer obtained from an experiment.
Figure 15B:
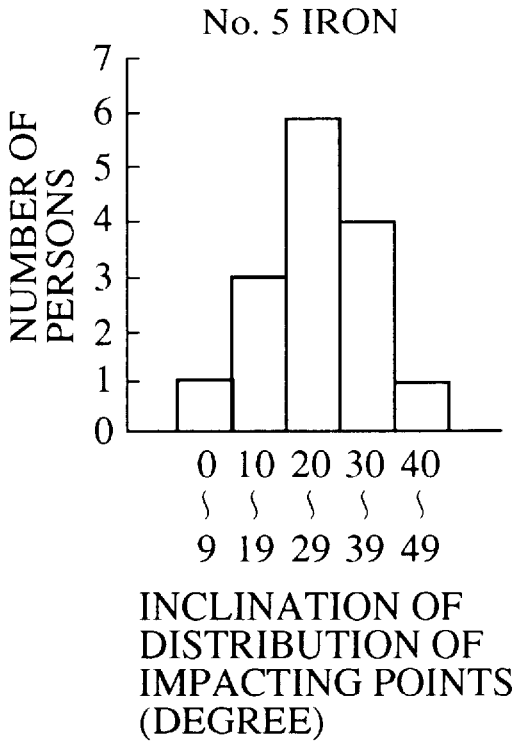
FIG. 15B is a graphical representation showing a distribution of numbers of persons concerning an inclination of a distribution of impacting points of an average golfer obtained from an experiment.
Figure 15C:
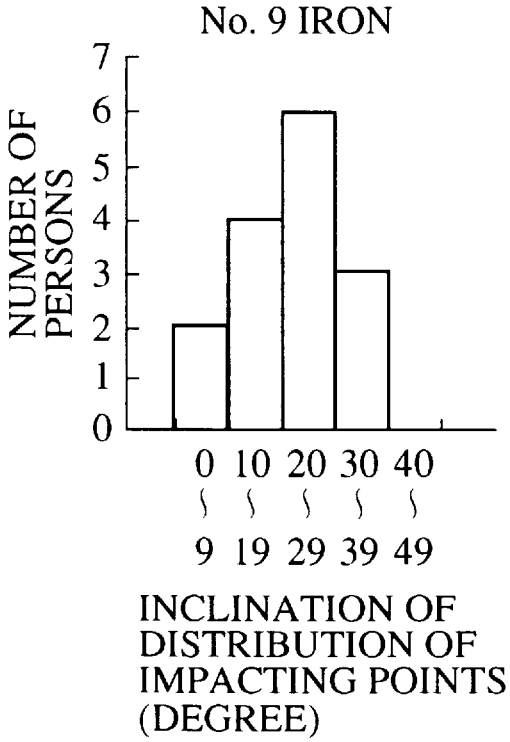
FIG. 15C is a graphical representation showing a distribution of numbers of persons concerning an inclination of a distribution of impacting points of an average golfer obtained from an experiment.

A coefficient of restitution at the point B was measured because, as shown in FIG. 6, a straight line M joining the point A and the point B intersects a horizontal direction on the face 15*b* at an angle γ of approximately 27°, and when the straight line M is projected on the XZ plane of the XYZ coordinate system, the projected line intersects the X axis at 24.0°, and the straight line M coincides with the direction of the most number of persons among the distribution of the numbers of persons concerning the inclinations of distributions of impacting points shown in FIG. 15A, FIG. 15B, and FIG. 15C. In other words, when the sweet area inclines, at the same angle with the major axis of the range of the distribution of impacting points, lowering of the coefficient of restitution at the point B from the coefficient of restitution at the point A becomes smaller.

The coefficient of restitution at the point A, the coefficient of restitution at the points B, and proportion of the coefficient of restitution at the point B against the coefficient of restitution at the point A (lowering ratio of the coefficient of restitution) concerning each of the golf club heads of the first to sixth embodiments and the first to third examples for comparison are shown in Table 2.

It is confirmed from this Table 2 that in cases of the golf club heads of the first to sixth embodiments, lowering of the coefficient of restitution at the point B against the coefficient of restitution at the point A is small in comparison with the first to third examples for comparison and the distribution of the sweet area coincides with the distribution of impacting points of an average golfer.

Figure 7:
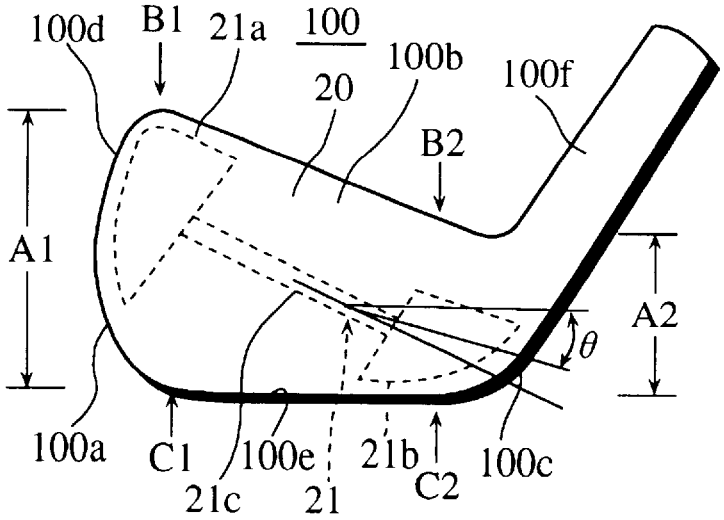
FIG. 7 is a front view of another golf club head according to the present invention.

It is also preferable to arrange said iron-type golf club head to have a construction of a seventh embodiment shown in FIG. 7, wherein a principal axis of inertia which intersects the X axis at a most acute angle intersects at an angle between 10° and 40° so that the inclination of the sweet area coincides with the inclination of the distribution of impacting points. FIG. 8A, FIG. 8B, FIG. 8C, and FIG. 8D are illustrations for explaining a method for manufacturing the iron-type golf club head shown in FIG. 7.

The iron-type golf club head 100 of the seventh embodiment is manufactured through a lost wax process, and a head main body member 20, which is made of metal lighter than an insert member, contains an insert member 21 which is made of metal heavier than the head main body. The insert member 21 comprises a buried portion 21*a* which is buried in the upper portion of the toe 100*a* side, a buried portion 21*b* which is buried in the lower portion of the heel side 100*c*, and a rib 21*c* connecting these buried portions 21*a*, 21*b*. In the seventh embodiment, the head main body member 20 is formed with stainless steel, and the insert member 21 is formed with tungsten. As shown in FIG. 8, the buried portions 21*a* and 21*b* of the insert member 21 are approximately triangular boards, and the buried portion 21*a* which is buried in the upper portion of the toe side is slightly curved.

A coefficient of linear expansion of the insert member 21 made of tungsten is approximately $6.1\times10^{-6}$/°C. under a temperature between room temperature and 800° C., and a thermal conductivity is 0.17 cal/cm • s • °C. under a temperature between room temperature and 400° C. On the other hand, a coefficient of linear expansion of the head main body member 20 made of stainless steel is approximately $17.0\times10^{1-6}$/°C. under 25° C., and a thermal conductivity is 0.18 cal/cm • s • °C. under 0° C.

It is preferable to use materials having similar coefficients of linear expansion and thermal conductivity for the insert member 21 and the head main body member 20. Materials for the insert member 21 and the head main body member 20 are not limited to the materials described above, and materials having similar coefficients of linear expansion and thermal conductivity wherein a specific gravity of the head main body member is smaller than a specific gravity of the insert member are suitable.

Figure 8A:
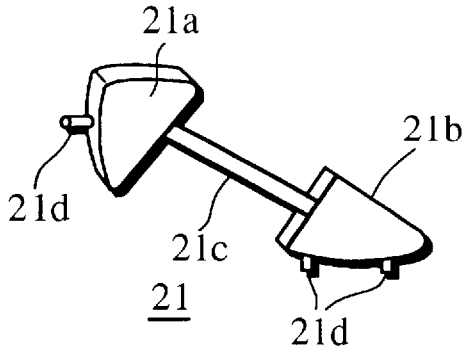
FIG. 8A is a schematic illustration showing a manufacturing process of a golf club head.
Figure 8B:
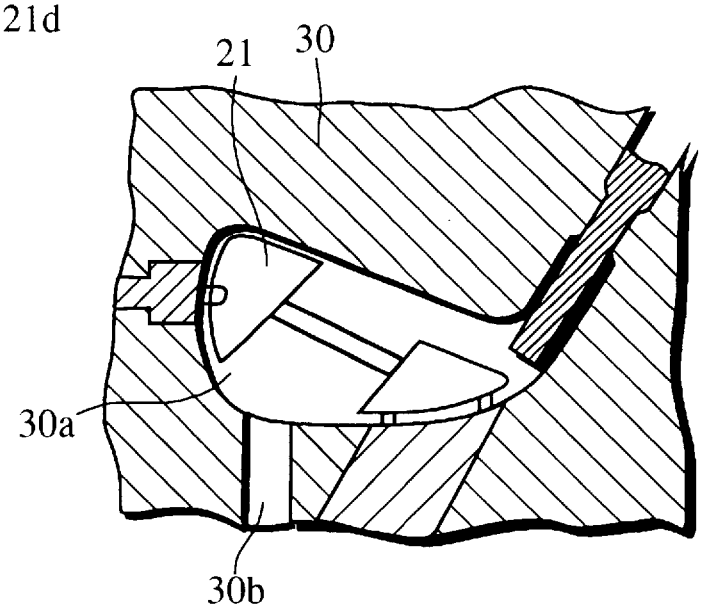
FIG. 8B is a schematic illustration showing a manufacturing process of a golf club head.
Figure 8C:
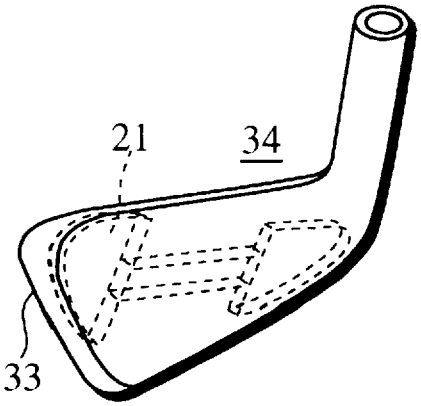
FIG. 8C is a schematic illustration showing a manufacturing process of a golf club head.

The iron-type golf club head 100 is produced through the lost wax process as described above. First, as shown in FIG. 8B, the insert Member 21 shown in FIG. 8A is supported by a supporting pin 21*d*, which is arranged to project from the insert member 21, and is placed and held at a predetermined position in a mold 30. Under this situation, molten wax 33 is poured into a cavity space 30*a* inside the mold 30 through a sprue 30*b*. After the wax 33 becomes stiffened, the mold 30 is removed and a wax head model 34 having a configuration of an iron-type head shown in FIG. 8C is formed. Next, the wax head model 34 is dipped into fireproof emulsion, and is covered with fireproof sand.

Figure 8D:
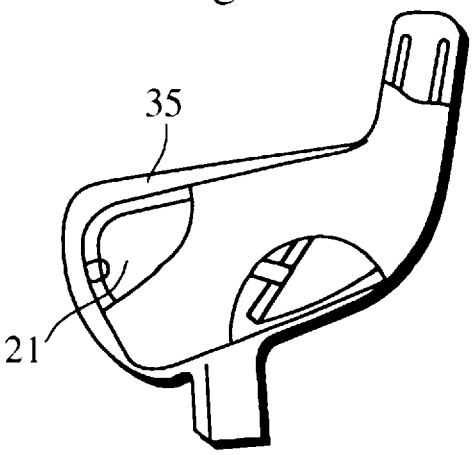
FIG. 8D is a schematic illustration showing a manufacturing process of a golf club head.

After drying the wax head model 34, the wax head model 34 is heated so that the wax 33 is melted down and a lost wax mold 35 shown in FIG. 8D is formed. This mold 35 is burned at a high temperature, molten metal to be the head main body member is poured into the mold with the insert member 21 inside. After casting, the lost wax mold 35 is broken, an iron-type golf club head is taken out, the sprue is removed, and the iron-type golf club head 100 shown in FIG. 7 is finished and produced.

The iron-type golf club head 100 of the seventh embodiment shown in FIG. 7 is 250 g in weight, 51.5 mm in width A1 at the toe 100*a* side of the face 100*b*, 32.5 mm in width A2 at the heel 100*c* side of the face 100*b*, 4.0 mm in width B1 of the blade 100*d* at the toe side, 4.0 mm in width B2 of the blade 100*d* at the heel side, 16.5 mm in width C1 of the sole 100*e* at the toe side, and 11.0 mm in width C2 of the sole 100*e* at the heel side. The length of the neck is 30 mm.

In case of the golf club head 100, an inclination θ of a principal axis of inertia which intersects the X axis at a most acute angle against the X axis was 15°, and this is within the range 10°–40° of the distribution of impacting points of an average golfer.

The iron-type golf club head 100 was made through the lost wax process and includes the insert member 21 inside in order to add a predetermined weight at the upper portion of the toe side and the lower portion of the heel side and the manufactured head itself is arranged to have the weight distribution with desired proportion. Therefore, it is possible to obtain a golf club head wherein the principal axis of inertia ξ intersects the X axis at an angle within a range of 10°–40° without inserting a balance member in a later process. As described above, the weight distribution is already arranged when the golf club head is manufactured, therefore the golf club head is favorable in directional stability.

The insert member 21 is arranged so that the buried portion in the upper portion of the toe side 21*a* and the buried portion in the lower portion of the heel side 21*b* are connected through the rib 21*c*, and is durable. Moreover, the weight distribution is arranged as desired by burying the insert member 21 inside the head, therefore it is possible to arrange the principal axis of inertia ξ to incline at a desired angle, while keeping a conventional configuration.

Figure 9A:
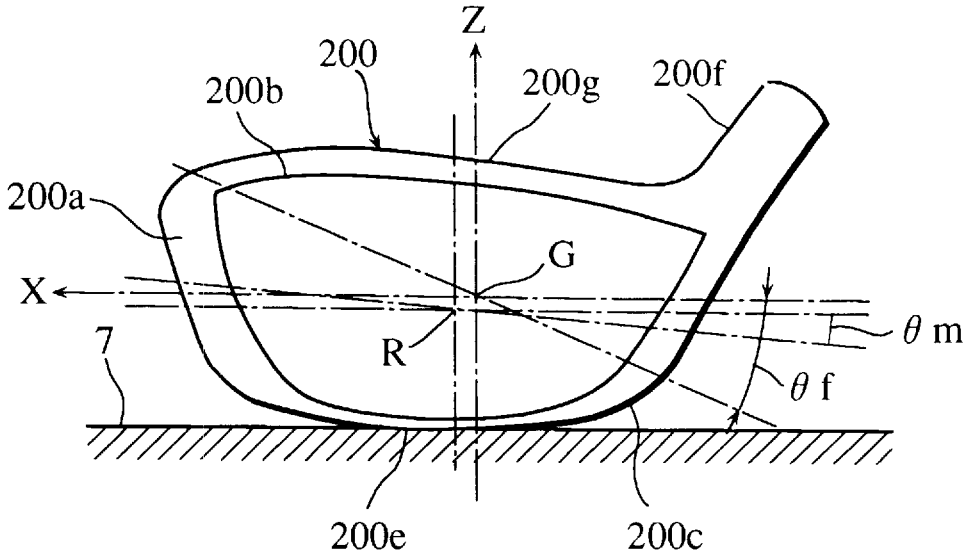
FIG. 9A is a front view of a wood-type golf club head according to the present invention.
Figure 9B:
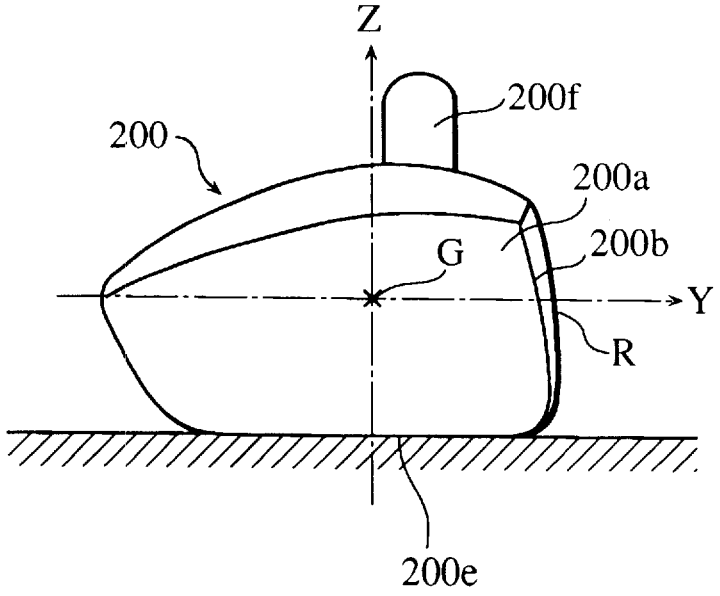
FIG. 9B is a side view of the golf club head of FIG. 9A.
Figure 10:
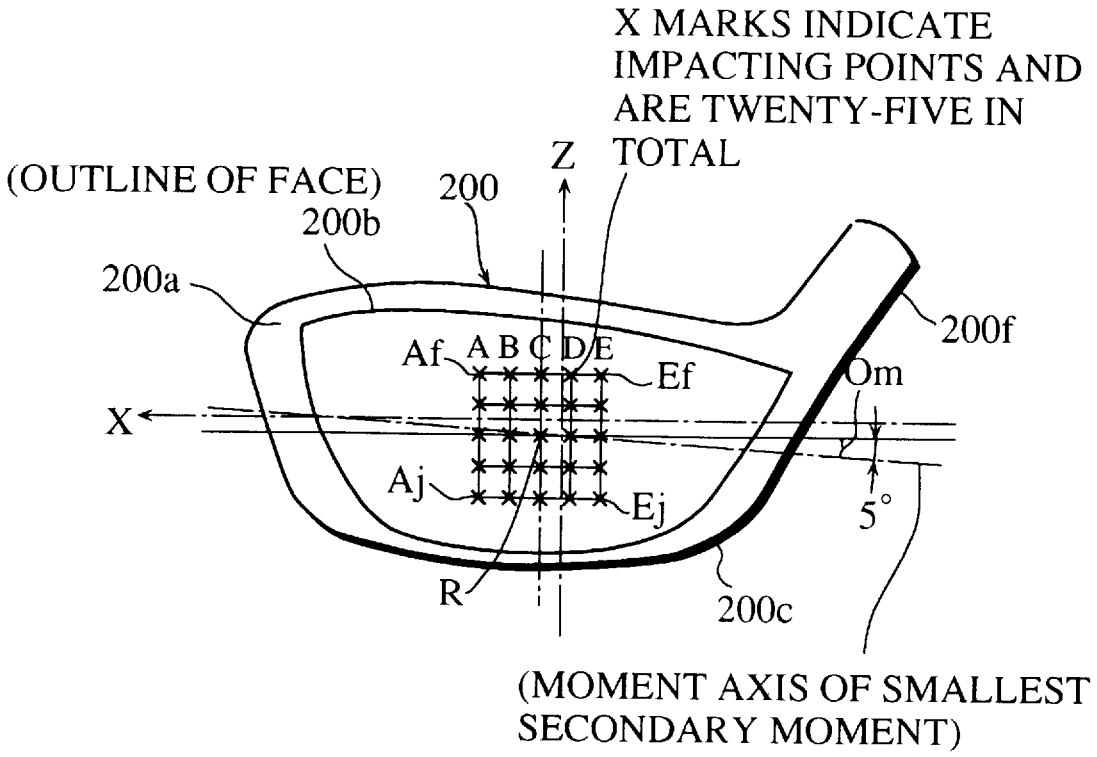
FIG. 10 is a front view of a wood-type golf club head for explaining impact points in an experiment.

FIGS. 9 to 11 show wood-type golf club heads 200 of the eighth to thirteenth embodiments. The principal axis of inertia ξ of each of these wood-type golf club heads 200 of the eighth to thirteenth embodiments is arranged to intersect the X axis at an angle between 10° and 40° keeping a conventional configuration and coincide with the distribution of impacting points of an average golfer.

As shown in FIG. 9, under a situation wherein the wood-type golf club head 200 is placed on a plane 7 forming a predetermined lie angle α and a predetermined loft angle β, with an axis in a direction perpendicular with the plane 7 as a Z axis, an axis parallel with straight line tangent to the midpoint of the face 200*b* of the golf club head and perpendicular with the Z axis as an X axis, an axis perpendicular with the Z axis and the X axis as a Y axis, and the center of gravity G of the golf club head as an origin, an angle between the X axis and a moment axis of a secondary moment which is the smallest among secondary moments of a region surrounding the outline of the face 200*b* when the golf club head 200 is observed from the direction of the Y axis is arranged to be between 0° and 20° (5° in case of the eighth embodiment) which range is approximately the same in a conventional golf club head.

When the golf club head is observed from the Y axis direction, an angle between the X axis and a moment axis of the smallest secondary moment (an axis corresponding to the smaller moment in the two moment axes) among the secondary moments of the region surrounding the outline of the face, i.e. an inclination θm of the moment axis against the X axis, is obtained through a method including the following procedures 1) to 4).

1) Photograph the wood-type golf club head from the Y axis direction, divide the face outline into approximately sixty parts, and read the face outline as coordinate axes using a digitizer.

2) Divide the region surrounded by the face outline into approximately two hundred square minute regions and calculate coordinates of each vertex.

3) Obtain a position vector $r_G$ of the center of the whole from the following equation with $A_K$ as the area of a minute region K and a position vector $r_K$=(XK, YK) as the coordinates of the center.

$$r_G = \frac{\Sigma A_k r_k}{\Sigma A_k} \qquad \text{Equation 8}$$

4) Secondary moments on coordinate axes X', Y' which pass the center and are parallel with the coordinate axes XY of a global coordinate system respectively are calculated through the following equations.

$$\begin{aligned} 1_{xx} &= \Sigma A_k y'_k y'_k \\ 1_{yy} &= \Sigma A_k x'_k x'_k \\ 1_{xy} &= 1_{yx} = \Sigma A_k x'_k y'_k \\ (x'_k, y'_k) &= r_k - r_G \end{aligned} \qquad \text{Equations 9}$$

An eigenvector corresponding to the smaller eigenvalue among the matrices of the following Equation 10 becomes a principal axis (moment axis) against the smallest secondary moment.

$$\begin{pmatrix} 1_{xx} & -1_{xy} \\ -1_{yx} & 1_{yy} \end{pmatrix} \qquad \text{Equation 10}$$

In each of the golf club heads 200 of the eighth to thirteenth embodiments, as described in the foregoing, when the golf club head is observed from the Y axis direction, an angle between the X axis and the moment axis of the smallest secondary moment among the secondary moments of the region surrounding the outline of the face, i.e. the inclination θm of the moment axis against the X axis, is between 0° and 20°, just as with a conventional golf club head. And, by changing the internal construction in case of a hollow head, or by placing weighting means on at least one of the upper portion of the toe 200*a* side and the lower portion of the heel 200*c* side, the weight distribution is changed so that a straight line formed by projecting a principal axis of inertia, which intersects the X axis at a most acute angle among the three principal axes of inertia that cross each other at right angles on the XZ plane, intersects the X axis at an angle θ f between 10° and 40° while keeping a conventional configuration.

The golf club heads 200 of the eighth to thirteenth embodiments have conventional external configurations and are acceptable for golfers. Moreover, as with the golf club heads of the first to seventh embodiments, an inclination of the sweet area coincides with the inclination of the major axis of the range of the distribution of impacting points of an average golfer, therefore it is possible for an average golfer to hit a golf ball accurately at the sweet area.

Factors of the eighth to thirteenth embodiments and the fourth example for comparison are shown in Table 3. The eighth embodiment has the same external appearance with the fourth example for comparison, and the size of the overall head excluding the neck in the up and down, left and right, and back and forth directions is reduced to 90% of the fourth example. The eighth embodiment is approximately similar to the fourth example for comparison.

TABLE 3

| Weight | Face Material Thickness | Crown Material Thickness | Sole Material Thickness | Neck Material Thickness | Weighting Material Weight | Inclination of Principal Axis of Inertia |
|---|---|---|---|---|---|---|
| Fourth Example for Comparison 198 g | Stainless Steel 3.0 mm | Stainless Steel 1.0 mm | Stainless Steel 1.5 mm | Stainless Steel 1.7 mm | — — | −7 degrees |
| Eight Embodiment 198 g | Stainless Steel 2.7 mm | Stainless Steel 0.9 mm | Stainless Steel 1.2 mm | Stainless Steel 1.5 mm | Stainless Steel 31 g | 10 degrees |
| Ninth Embodiment 198 g | Titanium 3.0 mm | Titanium 1.0 mm | Titanium 1.5 mm | Titanium 1.7 mm | Titanium 90 g | 15 degrees |
| Tenth Embodiment 198 g | Titanium 3.0 mm | Titanium 1.0 mm | Titanium 1.5 mm | Titanium 1.7 mm | Tungsten 90 g | 18 degrees |
| Eleventh Embodiment 198 g | Titanium 2.7 mm | Titanium 0.9 mm | Titanium 1.2 mm | — — | Tungsten 120 g | 35 degrees |
| Twelfth Embodiment 198 g | Titanium 3.0 mm | Titanium 1.0–10.0 | Titanium 1.5–10.0 | Titanium 1.7 mm | — — | 13 degrees |
| Thirteenth Embodiment 195 g | Persimmon | Persimmon | Persimmon | Persimmon | Stainless Steel 55 g | 11 degrees |

The wood-type golf club heads of the eighth to thirteenth embodiments (which are hereinafter abbreviated to "wood heads") have the same configurations as the configuration of the fourth example for comparison, which is a wood head TOUR SPECIAL '91 produced by Sumitomo Rubber Industries, Ltd. (Japan). In the fourth example for comparison, the angle between the X axis and the principal axis (moment axis) of the smallest secondary moment among the secondary moments of the region surrounded by the outline of the face is 5°, therefore, the angle is 5° also in the eighth to thirteenth embodiments.

The wood head of the fourth example for comparison has a hollow construction, and is made of stainless steel.

The wood head of the eighth embodiment has a hollow construction, and is reduced in thickness at the face 200*b*, the crown 200*g*, the sole 200*e*, and the neck 200*f* as compared with the fourth example for comparison. The reduced weight (51 g) is caused by reducing the size to 90% and changing the thickness to be equally distributed in the upper portion of the toe 200*a* and the lower portion of the heel 200*c*. To be concrete, a mass of stainless steel of 25.5 g was weld and fixed on an inner face of the shell at each of the upper portion of the toe side and the lower portion of the heel side.

The wood head of the ninth embodiment also has a hollow construction and is made of titanium alloy which has a specific gravity smaller than that of the stainless steel of the fourth example for comparison, and the reduced weight of 90 g was equally distributed in the upper portion of the toe side and the lower portion of the heel side. To be concrete, a mass of titanium alloy of 45 g shaped in a configuration of the inner portion of the shell of the head was welded and fixed on an inner face of each of the upper portion of the toe side and the lower portion of the heel side.

The wood head of the tenth embodiment also has a hollow construction and is made of titanium alloy just as with the ninth embodiment, and the reduced weight of 90 g was equally divided into two masses of tungsten alloy of 45 g shaped in configurations of the inner portion of the shell of the head and fixed on an inner face of the shell of the upper portion of the toe side and the lower portion of the heel side using adhesives. Besides using adhesives, it is possible fix the masses through a method of shrinkage fit or bond casting. Unlike the ninth embodiment, the tenth embodiment uses a material of high specific gravity in order to increase inclinations of the principal axes of inertia as compared with that of the eighth embodiment by reducing the volume of the weighting means and effectively distributing weight in a desired portion. It is possible to distribute weight in a position apart from the center of gravity, and this is advantageous in increasing the moment of inertia.

The wood head of the eleventh embodiment also has a hollow construction and is made of titanium alloy. And, thickness at the face, crown, and sole is thinner in comparison with the fourth embodiment. Moreover, the wood head is not provided with a protrusion at the neck. A great amount of weight, 120 g, was reduced and equally divided into two masses of tungsten alloy of 60 g shaped in configurations of the inner portion of the shell of the head, and was attached to the upper portion of the toe side and the lower portion of the heel side using adhesives. The eleventh embodiment is slightly inferior in the strength of the connection between the head and the shaft and the strength of the whole head. However, it is possible to use the wood head for a golfer who swings a golf club with a head speed of at most 38 m/s when striking a ball.

The wood head of the twelfth embodiment also has a hollow construction and a same external appearance as that of the wood head of the fourth example for comparison, in which the crown gradually becomes thick from the heel side to the toe side, i.e. 1 mm at the heel side and 10 mm in the vicinity of the end of the toe. On the other hand, the sole gradually becomes thin from the heel side to the toe side, i.e. 10 mm at the heel side and 1.5 mm in the vicinity of the end of the toe. The eleventh embodiment is relatively ineffective in inclining the principal axes of inertia, however, the wood head is easily manufactured because only one kind of metal is used, and it is possible to avoid stress concentration which occurs when the thickness is not continuous.

The wood head of the thirteenth embodiment has a solid construction made of wood (persimmon) and a configuration formed by reducing a wood head PRO MODEL DP-901 manufactured by Sumitomo Rubber Industries, Ltd. 'Japan) to 95% in up and down, left and right, and back and forth directions, and is provided with a weighting means of 55 g in order to adjust the weight of the wood head to the target head weight, 195 g. The weight of 55 g is divided into two masses of stainless steel of 27.5 g, and the weight was buried in the upper portion of the toe side and the lower portion of the heel side. The principal axis of inertia in this case was 11°.

Figure 11A:
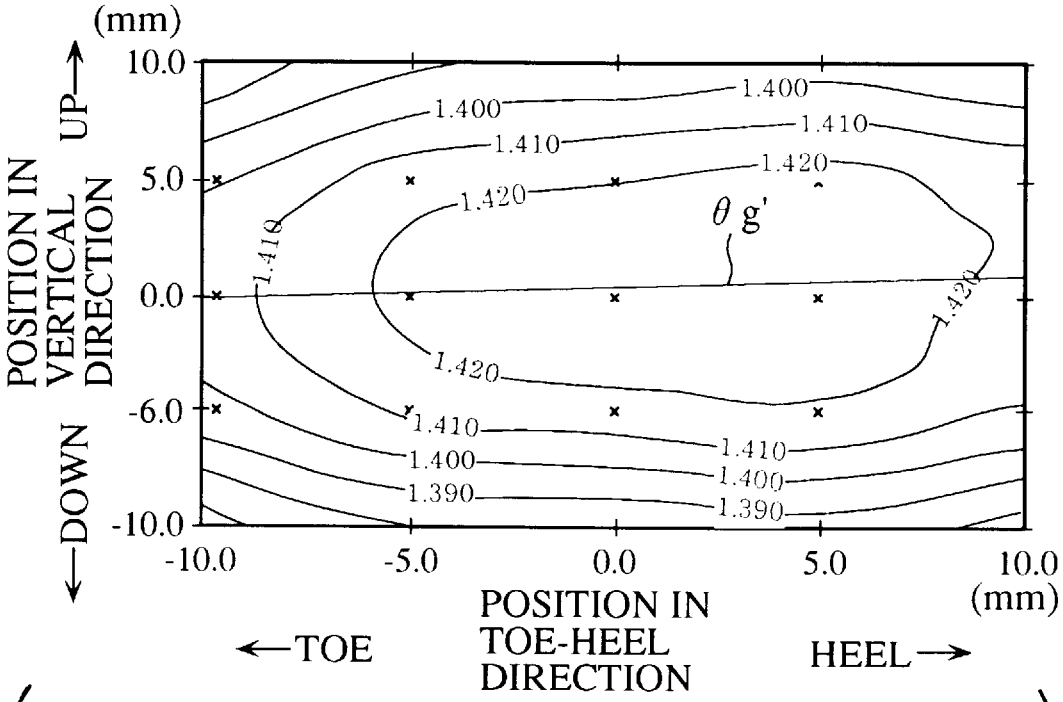
FIG. 11A is a contour map showing test results.
Figure 11B:
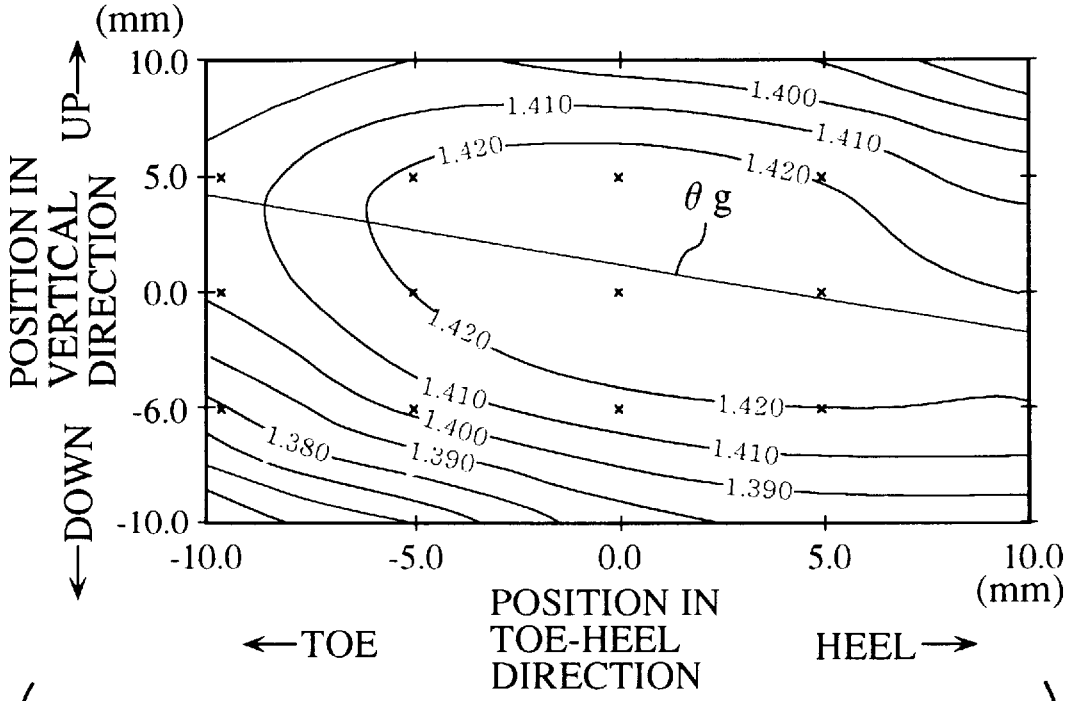
FIG. 11B is a contour map showing test results.
Figure 12A:
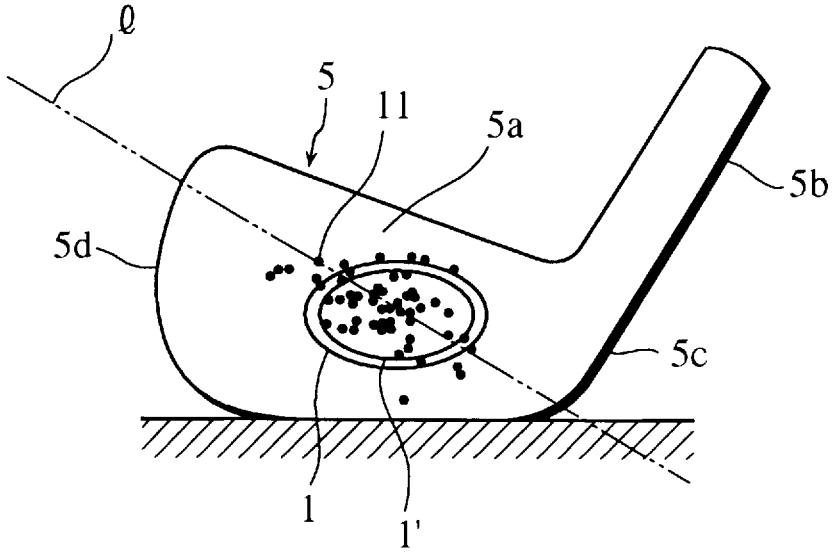
Fig. 12A PRIOR ART
FIG. 12A is a front view showing a conventional sweet area of a golf club head.
Figure 12B:
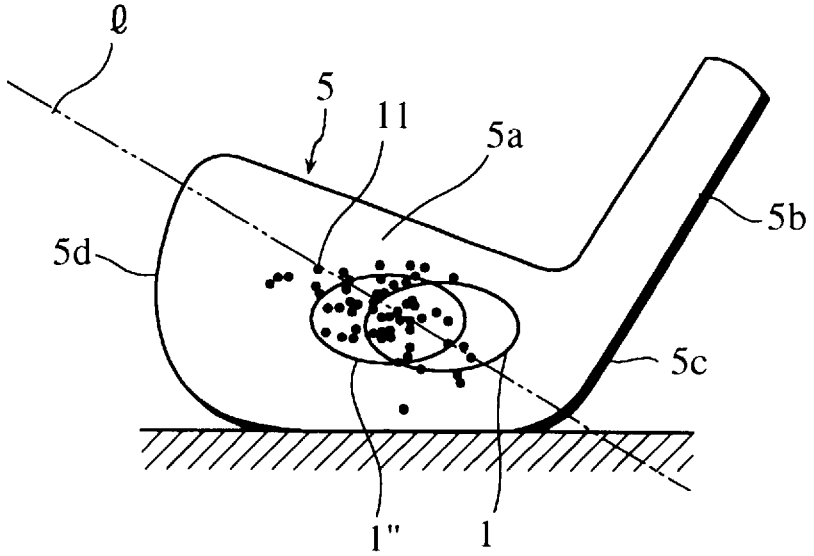
Fig. 12B PRIOR ART
FIG. 12B is a front view showing a conventional sweet area of a golf club head.

In order to confirm effectiveness of the wood-type golf club heads of the eighth to thirteenth embodiments, an experiment was conducted on the tenth embodiment as one of the eighth to thirteenth embodiments and the fourth example for comparison, wherein a ball was hit with each head using a machine for hitting balls, a coefficient of restitution (a ball speed/a head speed) at a position of each impacting point shown in FIG. 10 was measured, and distribution of coefficients of restitution at each of the impacting positions was indicated with contour lines shown in FIG. 11A and FIG. 11B using an analysis software micro-RESEARCHER of NEC Corporation, (Japan)).

The impacting points shown in FIG. 10 were positioned by arranging five impacting points (A to E) at intervals of 5 mm from the toe 200*a* side to the heel 200*c* side with the center R of the face as the datum point, five impacting points A to E (Af to Aj - Ef to Ej) at intervals of 5 mm from the upside to the downside of the face, and twenty-five impacting points were thus arranged. For each impacting point, a golf ball was impacted for six times and an average of coefficients of restitution at the six impacts is used as a coefficient of restitution of the impacting point.

Contour lines of FIG. 11A show contour lines of coefficients of restitution of the fourth example for comparison, and FIG. 11B shows contour lines of coefficients of restitution of the tenth embodiment. It is obvious from FIG. 11A and FIG. 11B that contour lines of coefficients of restitution at the heel side and the toe side do not incline, or have an inclination of θ g' toward the heel side in the conventional golf club head of the fourth example for comparison. On the other hand, contour lines incline from the lower portion of the heel side to the upper portion of the toe side in the tenth embodiment.

This inclination θ g is approximately 17.2° on the face and 16.9° when projected on the XZ plane, and approximately coincides with the inclination of the principal axis of inertia.

An experiment was executed in which a golf ball was hit by an average golfer using each golf club head of the tenth embodiment and the fourth example for comparison. In the case of using the golf club head of the tenth embodiment, in comparison with the golf club head of the fourth example for comparison, restitution was improved even when a ball was hit at a point slightly Off from the sweet spot toward the upper portion of the toe side or the lower portion of the heel side, and the shock at impact was decreased.

According to the present invention, a straight line formed by projecting a principal axis of inertia, that intersects the X axis at a most acute angle among three principal axes of inertia on the XZ plane, intersects the X axis at an angle between 10° and 40°. It is therefore possible to arrange the sweet area on the face to approximately coincide with the distribution of impacting points of an average golfer.

Consequently, when a golf ball was hit by an average golfer using this golf club head, it is possible to hit the golf ball at the sweet area and the golf ball flies, a long distance toward a desired direction.

When a principal moment of inertia on the principal axis of inertia, that intersects the X axis at the most acute angle among the three principal axes of inertia, is arranged to be smaller than a principal moment of inertia on a principal axis of inertia that intersects the Z axis at a most acute angle among the three principal axes of inertia, the length of the sweet area on the face in a direction from the upper portion of the toe side to the lower portion of the heel side becomes longer than the length in a direction perpendicular with the aforementioned direction, and the configuration of the sweet area becomes similar to the configuration of the distribution of impacting points of an average golfer. Therefore, it is possible to raise the probability if impacting a golf ball on the sweet area and further increase a distance and directional stability of a ball hit by an average golfer using this club head.

Moreover, it is possible to arrange the principal axis of inertia, that intersects the X axis at the most acute angle among the three principal axes of inertia, to intersect the X axis at an angle between 10° and 40° by changing the weight distribution of the golf club head without changing the outer configuration on a large scale, and the sweet area on the face approximately coincides with the distribution of impacting points of an average golfer.

Especially when the weight distribution in the upper portion of the toe side and the lower portion of the heel side is increased, or when the neck portion is made of a material which has a specific gravity smaller than that of the other portion of the head, it is possible to easily arrange the aforementioned angle to be between 10° and 40°.

According to the wood-type golf club head of the present invention, it is possible to arrange the inclination of the sweet area to coincide with the distribution of impacting points keeping an outer configuration of a conventional wood-type golf club head. When an average golfer hits a golf ball using this wood-type golf club head, the golf ball is impacted on the sweet area with higher probability and Flies a longer distance toward a desired direction.

It is possible to easily arrange the Inclination of the sweet area of said wood-type golf club head to coincide with the inclination of the distribution of impacting points by increasing the weight distribution to the upper portion of the toe side and the lower portion of the heel side without changing the external configuration from a conventional configuration.

While preferred embodiments of the present invention have been described in this specification, it is to be understood that the invention is illustrative and not restrictive, because various changes are possible within the spirit of the invention.

For example, it is possible to arrange the main body of the golf club head according to the present invention to have a solid construction or a hollow construction composed by wood, resin, or composite material.

What is claimed is:

1. A golf club head, comprising:

a weight distribution which creates a principal axis of inertia intersecting an X axis on an XZ plane at a most acute angle among three principal axes of inertia perpendicular with each other at an angle between 10° and 40°, wherein when the golf club head is placed on a plane with a predetermined loft angle and coordinate axes are arranged with a center of gravity of the golf club head as an origin, a Z axis is an axis perpendicular with the plane, the X axis is an axis perpendicular with the Z axis and parallel with a tangent of a midpoint of a face of the golf club head, and a Y axis is an axis intersecting the X axis and the Z axis at right angles.

2. The golf club head as set forth in claim 1, wherein said weight distribution further creates a principal moment of inertia on the principal axis of inertia intersecting the X axis at the most acute angle among the three principal axes of inertia perpendicular with each other which is smaller than a principal moment of inertia on a principal axis of inertia intersecting the Z axis at a most acute angle among the three principal axes of inertia perpendicular with each other.

3. The golf club head as set forth in claim 1, wherein said weight distribution is increased in at least one of an upper portion of a toe side and a lower portion of a heel side.

4. The golf club head as set forth in claim 1, claim 2, or claim 3, wherein the golf club head is iron-type and a neck portion of the golf club head is made of a material having a specific gravity smaller than that of a material forming other parts of the golf club head.

5. The golf club head as set forth in claim 3, wherein said weight distribution is increased in at least one of the upper portion of the toe side and the lower portion of the heel side by applying metal, having a specific gravity larger than that of metal forming a head member, to at least one of the upper portion of the toe side and the lower portion of the heel side.

6. A wood-type golf club head, comprising:

a weight distribution, with an increased weight in at least one of an upper portion of a toe side and a lower portion of a heel side, creating a principal axis of inertia intersecting an X axis at a most acute angle among three principal axes of inertia perpendicular with each other on an XZ plane at an angle between 10° and 40°, and creating, among secondary moments of a region surrounding an outline of the face observed from a direction of the Y axis, a moment axis of the smallest secondary moment intersecting the X axis at an angle between 0° and 20°, wherein when the golf club head is placed on a plane with a predetermined loft angle and coordinate axes are arranged with a center of gravity of the golf club head as an origin, a Z axis is an axis perpendicular with the plane, the X axis is an axis perpendicular with the Z axis and parallel with a tangent of a midpoint of a face of the golf club head, and a Y axis is an axis intersecting the X axis and the Z axis at right angles.

7. The wood-type golf club head as set forth in claim 6, further comprising a hollow interior, and wherein at least one of the upper portion of the toe side and the lower portion of the heel side has a thickness greater than other portions of the golf club head.

8. The wood-type golf club head as set forth in claim 6, further comprising a main body made of at least one of a wood, a resin, and a composite material, and wherein said weight distribution includes a metal, having a specific gravity larger than that of said material forming the main body, attached to at least one of the upper portion of the toe side and the lower portion of the heel side.

* * * * *